US009068373B2

(12) United States Patent
Sickler et al.

(10) Patent No.: US 9,068,373 B2
(45) Date of Patent: Jun. 30, 2015

(54) WET NICHE AND ACCESSORIES FOR VINYL AND SPRAYED CEMENT POOLS

(76) Inventors: Perry Sickler, Endicott, NY (US); Edward J. Calafut, Vestal, NY (US)

( * ) Notice: Subject to any disclaimer, the term of this patent is extended or adjusted under 35 U.S.C. 154(b) by 395 days.

(21) Appl. No.: 13/417,926

(22) Filed: Mar. 12, 2012

(65) Prior Publication Data

US 2012/0227176 A1 Sep. 13, 2012

Related U.S. Application Data

(60) Provisional application No. 61/451,871, filed on Mar. 11, 2011.

(51) Int. Cl.
*E04H 4/00* (2006.01)
*E04H 4/14* (2006.01)

(52) U.S. Cl.
CPC . *E04H 4/14* (2013.01); *E04H 4/148* (2013.01)

(58) Field of Classification Search
CPC ..... E04H 4/12; E04H 4/14; E04H 4/148; A61H 33/0087; A61H 33/02; A61H 33/025; A61H 33/026; A61H 33/027; A61H 33/028; A61H 33/14
USPC ..... 4/488, 494, 496, 507, 506, 541.6, 492
See application file for complete search history.

(56) References Cited

U.S. PATENT DOCUMENTS 3,722,816 A * 3/1973 Stewart et al. ..... 239/17
4,008,497 A 2/1977 Badon
4,170,044 A * 10/1979 Steimle ..... 4/488
4,776,046 A 10/1988 Newberry et al.
5,040,251 A 8/1991 Hanford
5,184,377 A * 2/1993 Ragsdale et al. ..... 24/704.1
5,441,433 A 8/1995 Stanley
5,860,171 A 1/1999 Hicks
6,055,683 A 5/2000 Komer
6,209,147 B1 4/2001 Wheaton
6,405,387 B1 * 6/2002 Barnes ..... 4/541.2
D468,116 S 1/2003 Champion (Continued)

FOREIGN PATENT DOCUMENTS

GB 347721 4/1931

OTHER PUBLICATIONS

A.G. Streng. Tables of Ozone Properties. Jul. 1961. Journal of Chemical and Engineering Data, vol. 6, No. 3.*

(Continued)

*Primary Examiner* — Lauren Crane
*Assistant Examiner* — Erin Deery
(74) *Attorney, Agent, or Firm* — Brown & Michaels, PC

(57) ABSTRACT

At least one socket in a swimming pool allows for the mounting of at least one pool accessory by way of a post mounted in the socket. In some embodiments, the socket is located in the bottom of the pool. In some embodiments, the socket is coupled to an electricity source to provide electricity to the post or pool accessory. In some embodiments, the socket is coupled to an air source to provide bubbles. In some embodiments, the socket is coupled to a fog source to provide a fog supply. In some embodiments, the socket is coupled to a water source to provide water flow to the post or pool accessory. In some embodiments, the fluid supplied to the post includes a scent. In some embodiments, the socket includes a light source and the post includes optical fibers to transmit light from the light source through the post.

16 Claims, 6 Drawing Sheets

(56) References Cited

U.S. PATENT DOCUMENTS

| | | | | |
|---|---|---|---|---|
| 6,878,026 | B2 | 4/2005 | Cloutier | |
| 7,080,816 | B1 * | 7/2006 | Vaccaro | 248/545 |
| 7,146,657 | B2 | 12/2006 | Jahnke | |
| 7,217,022 | B2 * | 5/2007 | Ruffin | 362/554 |
| 7,293,840 | B1 | 11/2007 | Schu | |
| 7,775,457 | B2 * | 8/2010 | Schnuckle | 239/12 |
| RE43,492 | E * | 6/2012 | Willis et al. | 362/267 |
| 8,499,373 | B2 * | 8/2013 | Saviano | 4/496 |
| 2009/0320396 | A1 * | 12/2009 | Knudsen | 52/297 |

OTHER PUBLICATIONS http://www.thepoolbar.com/pdfs/PoolbarInstructions.pdf, Feb. 22, 2011, 4 pages.

* cited by examiner

WET NICHE AND ACCESSORIES FOR VINYL AND SPRAYED CEMENT POOLS

REFERENCE TO RELATED APPLICATIONS

This application claims one or more inventions which were disclosed in Provisional Application No. 61/451,871, filed Mar. 11, 2011, entitled "WET NICHE AND ACCESSORIES FOR VINYL AND SPRAYED CEMENT POOLS". The benefit under 35 USC §119(e) of the United States provisional application is hereby claimed, and the aforementioned application is hereby incorporated herein by reference.

BACKGROUND OF THE INVENTION

1. Field of the Invention

The invention pertains to the field of swimming pools. More particularly, the invention pertains to swimming pool accessories and structures and methods for mounting accessories to the bottom surface of swimming pools.

2. Description of Related Art

Conventionally, only a permanent pillar is used for seating in gunite pools. No good way is commercially available to put seating in a vinyl liner pool. No good existing method is commercially available to securely fix seating in vinyl liner pools without using a vinyl liner specially-designed for use with the seating, both in permanent and removable style seats. An existing commercial method mounts the seating to the edge of the pool outside the pool, but this limits the locations for the seating and obstructs the poolside. An alternate existing conventional method builds seating out of a solid tube of cement in both gunite and vinyl liner pools. In vinyl liner pools the pillars are covered with a vinyl liner, which allows for a seating area. This method is very imprecise for liner fit, which causes wrinkles in the liner in the pillar area. It also increases the cost of the liner and the cost of replacing the liner. In both gunite and vinyl pools, the commercially available in-pool seats are not removable. The conventional method of seating, cement pillars, is permanent and cannot be removed. Alternatively, movable chairs can be positioned in the pool bar area, but they are not stationary, and in vinyl liner pools these chairs can damage the vinyl liner causing tears and leaks.

Wet niches are commonly used in the walls of vinyl pools for underwater lighting or similar features.

U.S. Pat. No. 5,040,251, entitled "Method and Apparatus for Mounting of Upright Posts in Swimming Pools" and issued to Hanford on Aug. 20, 1991, discloses a method and apparatus for installing a mounting support for upright supporting posts in swimming pools, particularly of the type having a vinyl liner. A hollow tube having a closed lower end and a coupler collar at the upper end is embedded in the ground defining the bottom of the pool. A top plate and gasket are secured to the coupler collar with the vinyl liner positioned in between. An upright post for a swimming pool accessory may then be easily engaged in or disengaged from the mounting support. A pop-on cap may be fitted to the opening of the mounting support when the mounting support is not in use.

U.S. Pat. No. 6,209,147, entitled "Underwater Attachment System" and issued to Wheaton on Apr. 3, 2001, discloses a system for attaching accessories to a base structure that is disposed underwater in a pool, spa, or hot tub. The system includes an upright pedestal support assembly that is detachably-attachable with respect to the base by a twist-lock "bayonet" type of mounting system. This permits the pedestal support assembly to be attached to and removed from the base as desired. The base structure remains permanently attached to the surrounding structures that are disposed underwater at the bottom or sides. The surrounding structures are often formed of gunite. The base includes means of anchoring it in place and of reinforcing it to the surrounding structures. Various devices may be attached to the pedestal support assembly, including tables, umbrellas, stools, benches, basketball hoops and backboards, and thermometers. Some of these devices are detachably-attachable to the same pedestal support assembly while others require their own pedestal support assembly. The underwater attachment system enhances enjoyment and utility of aquatic areas.

U.S. Pat. No. 7,146,657, entitled "Water Equipment Attachment Apparatus" and issued to Jahnke on Dec. 12, 2006, discloses a water attachment equipment apparatus, which permits the attachment of water equipment such as ladders, handrails, sports equipment, chairs and other equipment into a containing structure of a contained body of water, such as a swimming pool, fountain, or decorative pond, including a flexible material liner such as a vinyl liner. The water attachment equipment apparatus can be attached to a top, side, or bottom of the containing structure of contained body of water through the vinyl liner without leaking and provides structural support for any attached water equipment.

U.S. Pat. No. 6,055,683, entitled "Swimming Pool Lane Marker for the Visually Impaired" and issued to Komer on May 2, 2000 discloses a swimming pool lane marker for the visually impaired including a perforated tube that extends the length of the swimming pool. The perforated tube is in fluid communication with a source of compressed gas, such as an air compressor. The air compressor delivers pressurized air to the tube. The pressurized air escapes through the perforations forming a line of bubbles along the swimming lane. A blind swimmer can feel these bubbles and determine his position in the swimming lane. The perforated tube is held under the water by a wire that extends between a pair of frame assemblies that connect the wire to the sidewall of the pool.

The above-mentioned patents are hereby incorporated by reference herein.

SUMMARY OF THE INVENTION

At least one socket in a swimming pool allows for the mounting of at least one pool accessory by way of a post mounted in the socket. In some embodiments, the socket is located in the bottom of the pool. In some embodiments, the socket is coupled to an electricity source to provide electricity to the post or pool accessory. In some embodiments, the socket is coupled to an air source to provide bubbles to the post or pool accessory. In some embodiments, the socket is coupled to a fog source to provide a fog supply to the post or pool accessory. In some embodiments, the socket is coupled to a water source to provide water flow to the post or pool accessory. In some embodiments, the fluid supplied to the post includes a scent. In some embodiments, the socket includes a light source and the post includes optical fibers to transmit light from the light source through the post.

DETAILED DESCRIPTION OF THE INVENTION

Figure 1B:
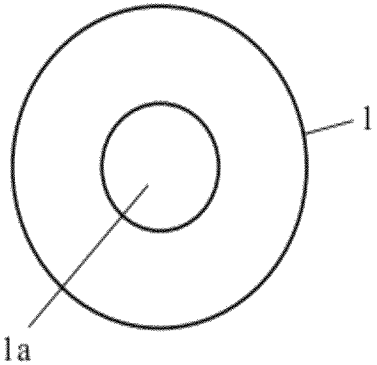
FIG. 1B shows a bottom view of the post of FIG. 1A.
Figure 1A:
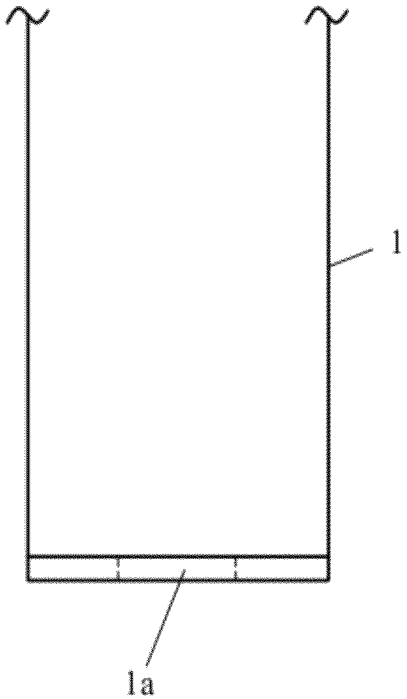
FIG. 1A shows a side view of a post in an embodiment of the present invention.
Figure 2B:
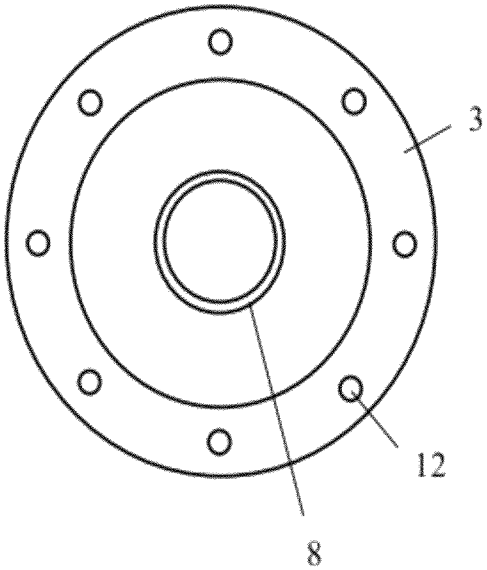
FIG. 2B shows a top view of the socket of FIG. 2A.
Figure 2A:
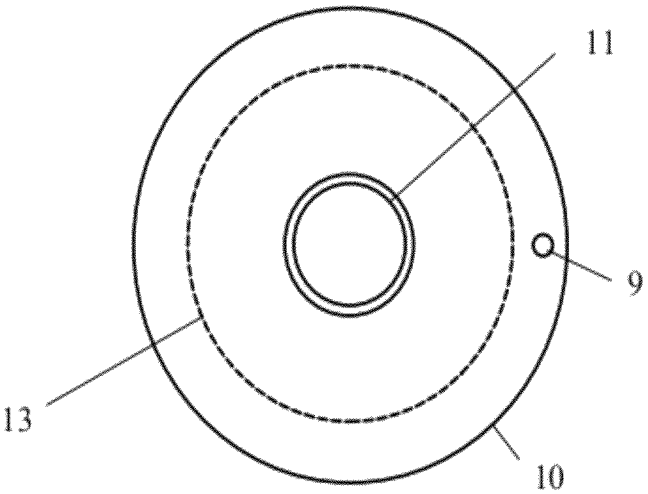
FIG. 2A shows a bottom view of a socket in an embodiment of the present invention.
Figure 3:
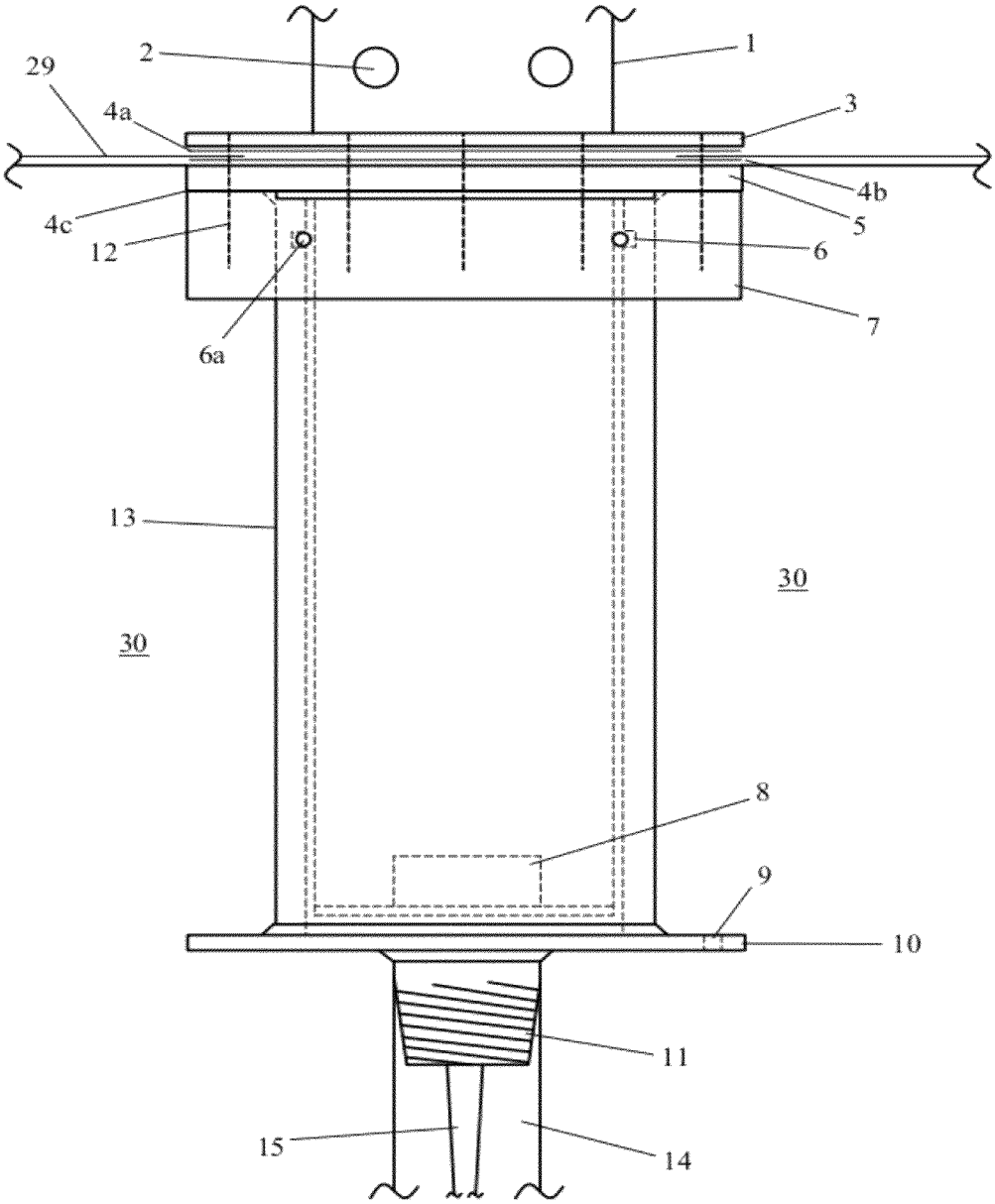
FIG. 3 shows a side view of the post of FIG. 1A installed in the socket of FIG. 2A.

In some embodiments, seating for a vinyl liner-type or a sprayed cement-type (also referred to as a gunite-type) swimming pool is mounted in a wet niche installed into the floor of the swimming pool. The seating is removable and can be securely fixed to the pool through the wet niche. Removable seats allow more swimming area and can be removed for safety issues and winterization of the pool. This style of seating allows customized air injection into the seating for a bubbler feature, a scent feature, or a fog feature, customized water injection, and lighting, including optical fibers, light-emitting diode (LED), or conventional lighting, to be installed.

In some embodiments, a waterproof vertical socket is installed in the floor of the swimming pool to receive the post for a seat. The socket is preferably installed in the ground at the time the pool is constructed, and the floor of the pool is preferably formed around the socket. The socket may be used with a pool floor formed from any material, including, but not limited to, sand, another packed granular material, or a packed granular composite, but the pool floor is preferably made of concrete. The socket is preferably a wet niche that seals with the vinyl liner to prevent pool water from getting under the liner. The post, with the seating attached, drops into the socket. The socket and post are preferably designed to have the ability to add air injection, fog injection, scent injection, lighting, and water injection for therapy jets. The socket and post are preferably made of stainless steel. Alternatively the socket or the post may be made of other metals, plastics, or carbon fiber.

The socket seals to the vinyl liner, which provides a waterproof niche for installation of the post of the seat. In vinyl liner pool applications, the socket preferably has a faceplate and gasket that allow the sealing of the socket to the pool liner. When no post is installed in the socket, a watertight cover or plug in the socket provides a relatively smooth pool bottom surface to prevent injury and promote cleaning of the pool. In vinyl liner pool applications, the socket is preferably positioned into the poured concrete slab under the liner and the base of the pool. The socket may alternatively be installed into the side of the pool for some applications. In some embodiments, the socket is sealed to the tube of the seating to allow air, fog, or scents to be injected into jets of the tubing or lighting wires such as optical fibers to be installed. In some embodiments, the socket receives a waterproof LED light. In other embodiments, the waterproof LED light is mounted in the socket.

In gunite pools no faceplate or gasket is needed. The socket is preferably positioned into poured cement in the bottom of the pool. The socket may alternatively be installed into the side of the pool for some applications. The tube may be a pipe cut to length for different heights of seating or it may be made with an adjustable height device. The tube may be solid or hollow. The seating may optionally include a footrest which may be either solid or adjustable.

The post preferably has the ability to have a fixed and removable seat attached to it for fixed and secure seating in a pool area. The seating may be a barstool style of seating, a bench style of seating, a sofa style of seating, or a chair style of seating. In addition to use with seating, the installed socket may be used alone or in combination with similar installed sockets to allow for the mounting of one or more posts for any pool accessory in the swimming pool, including, but not limited to a post for a hammock, a ladder post, a railing post, a basketball hoop post, a post for shading such as an awning, a table post, posts for a play structure such as a climbing structure, and posts for a volleyball net.

In some embodiments, the socket is connected or connectable to a fluid line. A fluid, as used herein, may be any liquid or gas. When the fluid is a gas, the socket is sealed with respect to the post, preferably by one or more o-rings, to prevent leakage of the air at the fitting. Fluid flow may be provided by any means, including, but not limited to, a compressor, a pump, or a pressurized air source. Additionally, the flowing fluid may be any aqueous liquid or any gas, including, but not limited to, air, oxygen, nitrogen, helium gas, and any formulation of fog produced by a fog machine. The fog source may be any formulation commonly referred to as "fog juice", including, but not limited to, water/glycol-based fluids, water/glycerin-based fluids, and mineral oil, and used to produce smoke by any method by a fog machine. Both actuation and speed of fluid flow is preferably controllable, either by a switch, a valve, or a combination of a switch and a valve. In some embodiments, a one-way valve is located in the socket to prevent backflow of water from the pool into the fluid line. The fluid is supplied at a pressure greater than the pressure of the pool water at the one-way valve in order to produce fluid flow. In some embodiments, the gas flow is used to make a bubbler. Holes may be included in the post or in any parts of the accessory for flow of the fluid out of the post or accessory. The holes may be located to provide aesthetically pleasing bubbles when the bubbler is activated. Alternatively, the holes may be located to provide a therapeutic value, such as in a foot rest or a chair back for the comfort of the user of the pool accessory. In some embodiments, a pleasant scent, such as a floral scent, is added to the flowing gas.

In some embodiments, the socket is connected to an electrical line such that lighting may be included in the post or the accessory mounted to the post. In some embodiments, the electrical line is designed with enough wiring so that the end of the wiring may be brought out of the socket and out of the pool water for coupling to a light or other electricity-powered device associated with the post or the mounted pool accessory. In some embodiments, the electrical line is disconnectable or turned off by a switch when not in use. In some embodiments, the light source may produce light that changes colors over time.

In some embodiments, two or more of liquid flow, gas flow, lighting, fog, or scent are used in combination to create various aesthetically pleasing effects.

FIG. 1A through FIG. 3 show a socket and a post in an embodiment of the present invention. The post 1 has a tubular shape with cylindrical sides and a flat bottom with a hole 1*a* in the middle of the bottom to seat on the post nipple 8 in the bottom of the socket 13. The socket 13 also has a tubular shape with cylindrical sides with a bottom flange 10 mounted to the bottom of the socket 13. The bottom flange includes at least one hole 9 for a bonding lug. The post nipple 8 extends upward from the bottom of the socket 13 and into the interior of the socket 13. The post nipple 8 locates the end of the post 1 to firm up the connection of the post 1 to the socket 13 and minimize, reduce, or eliminate wobbling of the post 1, when the post 1 is mounted in the socket 13.

At the upper end of the socket 13, an o-ring 6*a* seated in a notch 6 in the inner surface of the socket 13 forms an airtight seal between the outer surface of the post 1 and the inner surface of the socket 13. Alternatively, the notch may be located on the outer surface of the post. One or more gaskets 4*a*, 4*b* located between an upper flange 5 on the upper end of the socket 13 and a face plate 3, provide an airtight seal between the vinyl liner 29 and the socket 13. The vinyl liner 29 may be located directly above or directly below the gasket but is preferably between a pair of gaskets 4*a*, 4*b* between the upper flange 5 and the face plate 3. In the embodiment shown in FIG. 3, the top of the flange 5 is approximately even with the top surface of the cement floor 30. Alternatively, the floor surface may be somewhere in the range of being above the top of the flange 5 to even with the top of the face plate 3. The face plate 3 is affixed to the gasket 4 and upper flange 5 by fasteners inserted through a plurality of holes 12 through the face plate 3, gasket 4, and upper flange 5. A backing material 7 for the fasteners is located below the upper flange 5. A third gasket 4*c* is preferably located between the upper flange 5 and the backing material 7. The backing material 7 is preferably made of plastic.

An air nipple 11 extends downward from the bottom of the socket 13 to provide an airtight seal with the fluid flow line 14. An electrical line 15 is also shown in the fluid flow line 14. The bottom of the socket 13 may be open to allow fluid flow from the fluid flow line 14 into the interior of the post 1, or a one-way valve may be located between the post nipple 8 and the air nipple 11 to allow fluid to flow from the fluid flow line 14 into the interior of the post 1 but prevent pool water from entering the fluid flow line 14. Air flowing into the post 1 exits the post 1 into the swimming pool as bubbles through holes 2 in the post 1 or in the pool accessory connected to the post 1.

Figure 4:
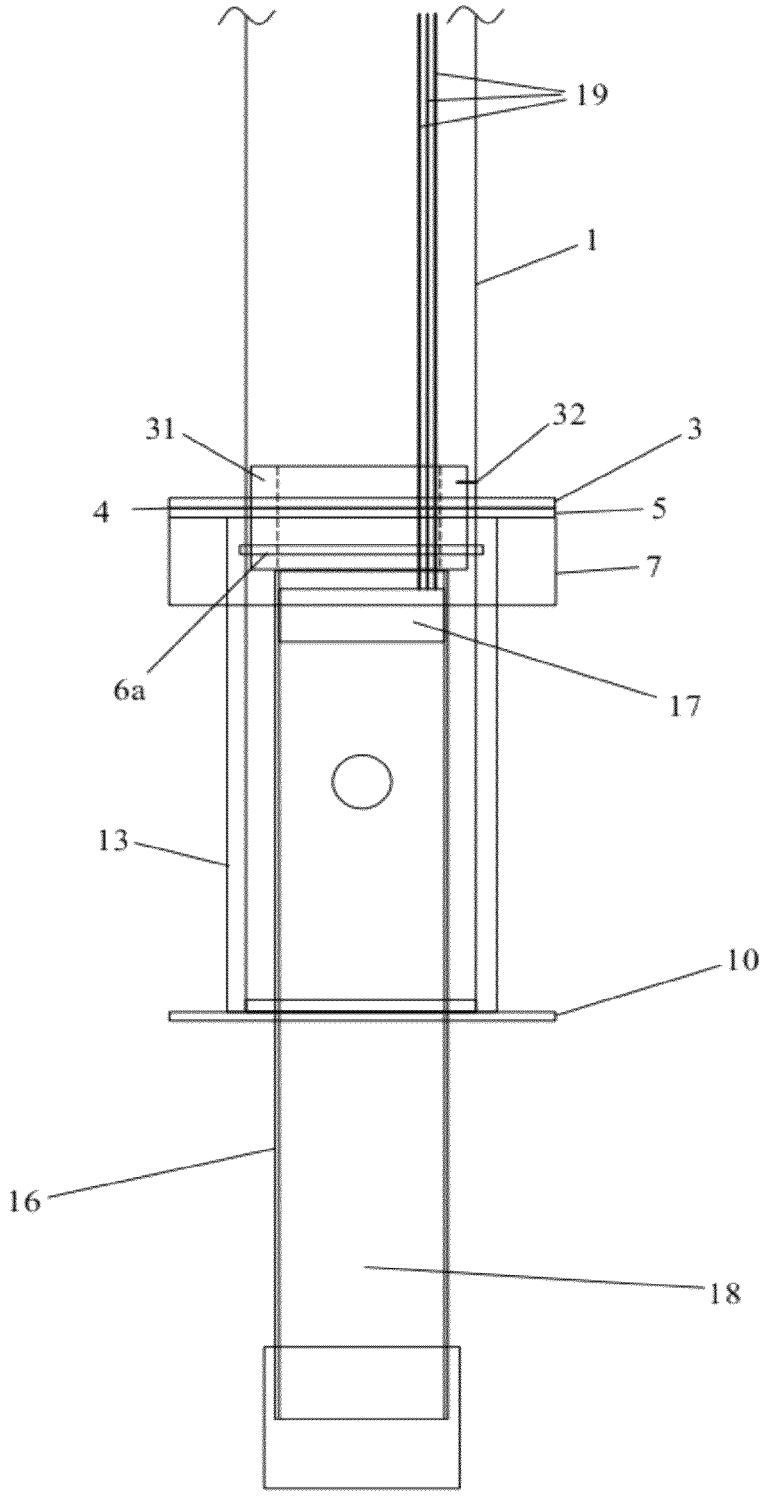
FIG. 4 shows a schematic side view of a post installed in a socket with a light source.

FIG. 4 shows an alternate assembly for transmission of light to the pool accessory or the water. Most of the elements of the socket are similar to the socket shown in FIG. 3, but the socket contains an additional housing 16 that contains a mounted light source 17 at the top of the housing 16. Although the top of the housing 16 is shown as being near the top of the socket 13, the housing 16 may alternatively be located lower in the socket 13 as long as the top of the housing 16 extends far enough into the socket 13 so that the ends of the optical fibers 19 in the post 1 are near the top surface of the light source 17 when the post is received in the socket 13. The light source 17 is preferably a light-emitting diode (LED) light source. When incorporated into a socket 13 similar to the socket 13 of FIG. 3, the housing 16 extends below the bottom flange 10 in order to provide space for the additional hardware 18 associated with conventional LED lights. The LED light 17 may be mounted in the socket 13 or removed and replaced when burnt out at any time as needed. The electrical line preferably can be turned on or off at either a plug or a switch located outside of the pool to turn the LED light on or off.

In some embodiments, the post 1 includes optical fibers 19. A centering puck 31 is held in the post 1 by one or more fasteners 32 and maintains the optical fibers 19 in place such that when the post 1 is mounted in the socket 13, as shown in FIG. 4, the ends of the optical fibers 19 sit directly above the LED source 17. In some embodiments, the fasteners 32 are stainless steel screws. This arrangement allows a user to connect the post 1 to, or disconnect the post 1 from, the socket 13 at any time during the pool season and for the light to be turned on or off by the switch or plug at any time. Although three optical fibers 19 are shown off-center in FIG. 4, any number of optical fibers 19 that fit in any portion within the centering puck 31 may be used within the spirit of the present invention. The centering puck 31 may have any cross sectional shape as long as it maintains the optical fibers 19 in an orientation such that the optical fibers sit above the LED light source. The ends of the optical fibers 19 are preferably located within half of an inch, and more preferably within a quarter of an inch, of the top surface of the LED light source. The light from the LED source is transmitted through the optical fibers 19 and up the post 1 to the other end of the optical fibers 19. The post 1 may have transparent or translucent portions or openings through which the light in the optical fibers enters the water to achieve an aesthetically pleasing effect. The pool accessory may also have transparent or translucent portions or openings on any surface of the pool accessory through which the light in the optical fibers enters the water to achieve an aesthetically pleasing effect.

Figure 5:
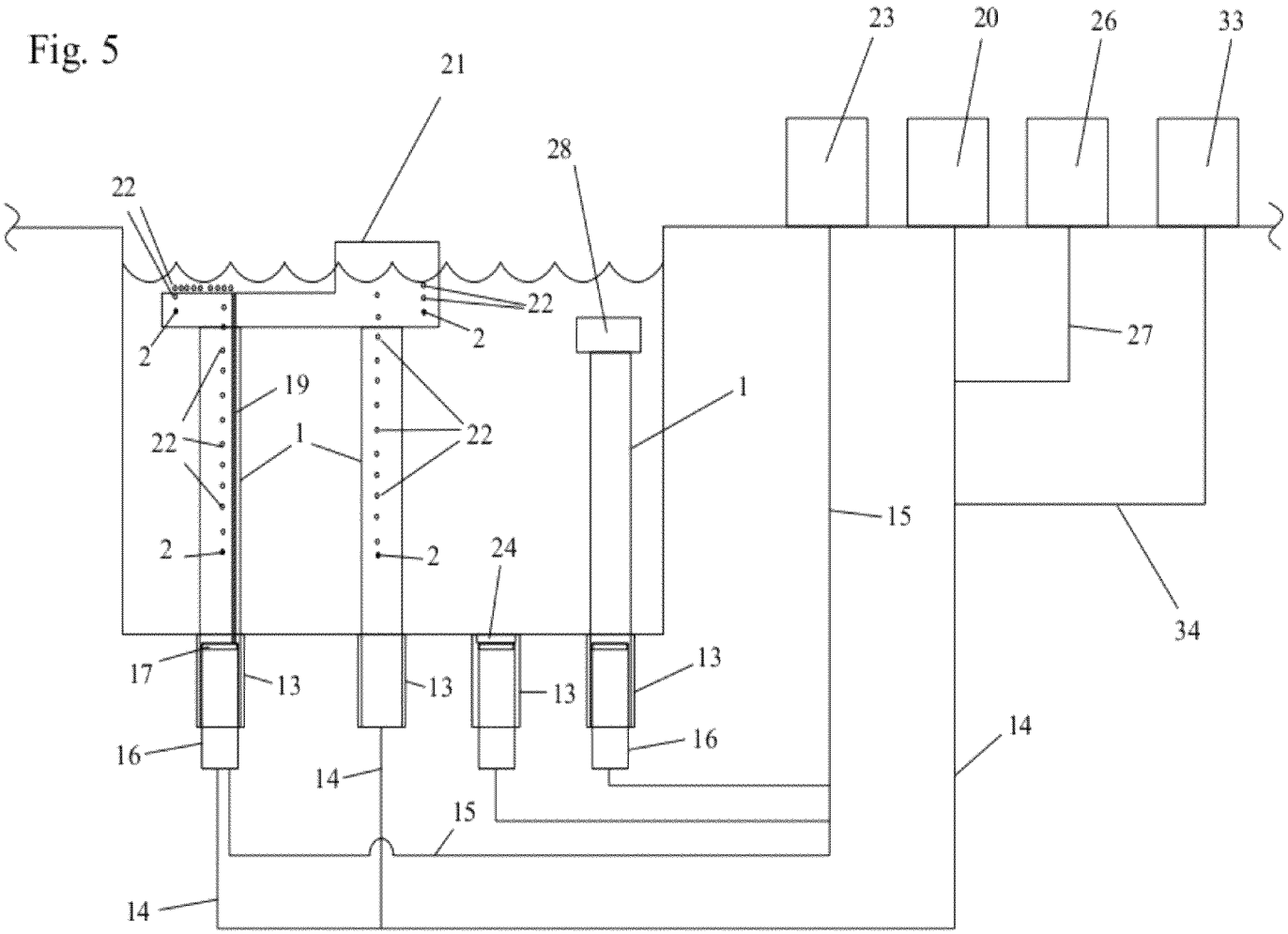
FIG. 5 shows a schematic view of sockets with fluid lines and electricity in a water pool in an embodiment of the present invention.

FIG. 5 shows a water pool, preferably a swimming pool or whirlpool, with multiple sockets, posts, and installed pool accessories illustrating various features of the pool accessory system. Air or another gas flows through the fluid flow lines 14 from the fluid flow source 20 to two of the sockets 13 and then through the holes 2 in the posts 1 and the pool accessory 21 to form bubbles 22 in the pool. Flow of the gas is preferably regulated, including turning on or off the air flow, at the fluid flow source either by a regulator, such as a valve, or a switch. Alternatively, water or an aqueous liquid may flow through the fluid flow lines 14. Additionally, a scent may be added to the fluid line 14 from a scent source 26. Flow of the scent is preferably controlled at the scent source 26. The scent source 26 may be added through a separate scent line 27 to the fluid line 14 or directly to the socket through the scent line 27. Additionally or alternatively, fog may be added to the fluid line 14 from a fog source 33. Flow of the fog is preferably controlled at the fog source 33. The fog source 33 produces fog, which goes to the water surface and produces a decorative effect. The fog source may be any type of fog-producing apparatus using any kind of "fog juice" to produce fog by any method. The fog source 33 may be added through a separate fog line 34 to the fluid line 14 or directly to the socket through the fog line 34. One of the sockets 13 includes an LED light source 17 mounted in a housing 16 in the socket 13. Optical fibers 19 transmit light from the LED to a surface of the pool accessory 21. Alternatively, the optical fibers 19 may terminate within the post 1 and transmit light to the water along the post to illuminate the rising bubbles 22 along the post 1

Two additional sockets 13 are shown as wired for electricity with an electrical line 15 from an electricity source 23 but not connected to a fluid source. One socket 13 holds a post 1 with a pool accessory 28 such as a seat but no electrical accessories. Since the other socket 13 is not currently in use, a cover 24 is inserted into the top hole of the socket 13. The cover 24 helps to keep debris out of the socket 13 and prevent injury to users of the pool near the socket 13. As shown in FIG. 5, the top surface of the pool accessory 21, 28 may be underwater or extend above the water surface and may be supported by a single post 1 or multiple posts 1.

Although the sockets are shown sharing an electricity source and sharing a fluid source, each socket may have a separate source or at least a separate control at the source such that the electricity or fluid flow may individually be turned on or off to each socket.

Figure 6B:
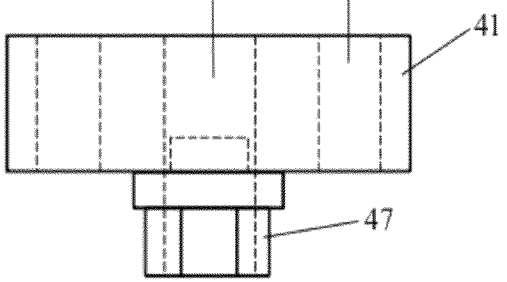
FIG. 6B shows a schematic side view of the centering puck of FIG. 6A.
Figure 6C:
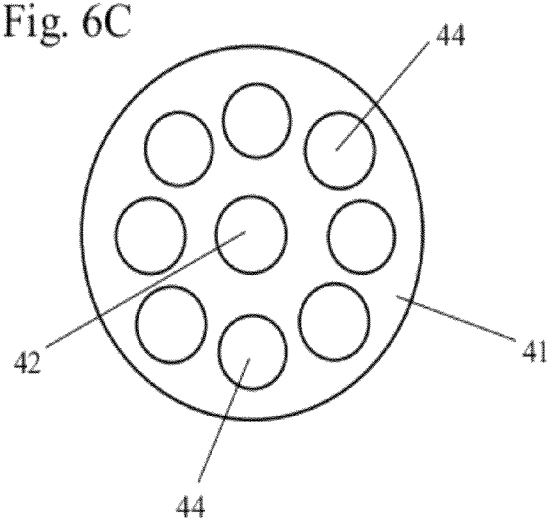
FIG. 6C shows a schematic top view of the centering puck of FIG. 6A.
Figure 6A:
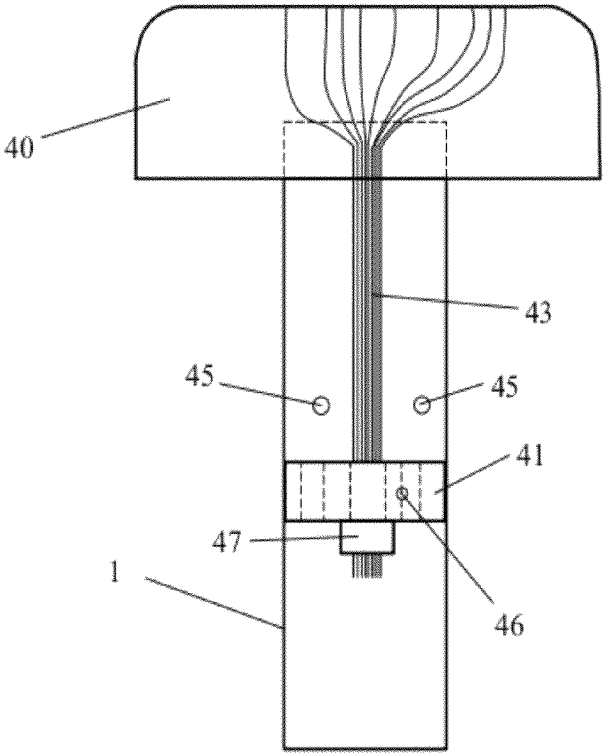
FIG. 6A shows a schematic view of seating with lighting in an embodiment of the present invention.

FIG. 6A, FIG. 6B, and FIG. 6C show a bar stool pool accessory with lighting. The seating 40 is mounted to the end of a mounting post 1. A centering puck 41 includes a center hole 42 receiving and aligning the optical fibers 43 arranged in the mounting post 1 and extending upward to the seating 40. The centering puck 41 also includes air holes 44 arranged around the center hole 42 to allow for air flow for bubbles or scent or fog or water to flow through the centering puck 41 and out the air holes 45. The centering puck 46 is mounted by a fastener through a fastener hole 46 in the mounting post 1. A fiber fastener 47 holds the ends of the optical fibers 43 together. In some embodiments, the fiber fastener is a compression-style nylon liquid-tight conduit fitting such as the fitting marketed under the trademark Heyco® (Heyco Products, Inc., Toms River, N.J. USA).

The socket and post may be made into any size needed. The product may be coated, painted, brushed, etc. Although the post and socket have been described and illustrated as cylindrical in shape, a different post and socket shape may be used within the spirit of the present invention, such as a round, square, rectangle, or spring shape. The post and seating may be made of any material, including, but not limited to, decorative stone, concrete, mortar, and wood. These items may be attached to the face of the seating or other accessory or the post for aesthetics.

The post and seating may be held in place in the socket by any means, including, but not limited to, the weight of the seat, a mechanical device or mechanism, or a magnetic device or mechanism.

In a preferred embodiment, multiple sockets are installed in the pool at the time of constructing the pool. Since the accessories are easily mountable and removable from the sockets, once the pool is constructed the owner can decide on whether or how to use the sockets, which allows for customization of the pool and re-customization for a new look or to suit the style of a new owner.

Accordingly, it is to be understood that the embodiments of the invention herein described are merely illustrative of the application of the principles of the invention.

Reference herein to details of the illustrated embodiments is not intended to limit the scope of the claims, which themselves recite those features regarded as essential to the invention.

What is claimed is:

1. A swimming pool accessory mounting system comprising:

at least one wet niche located in a floor portion of a swimming pool, the wet niche comprising:

a post socket having a first end and a second end opposite the first end and forming an enclosure;

a top flange mounted to the first end of the post socket;

a bottom flange mounted to the second end of the post socket;

a face plate mounted to the top flange; and a gasket forming a watertight seal between the top flange and the face plate:

at least one mounting post having a first end removably received by the post socket of the wet niche such that the mounting post extends from the wet niche into the swimming pool; and a fluid line extending through a foundation and supplying a fluid to the enclosure from a fluid source;

wherein the fluid is a gas and the mounting post has at least one through-hole in a side of the mounting post located underwater when the first end of the mounting post is received by the post socket, such that the gas bubbles out of the hole.

2. The swimming pool accessory mounting system of claim 1 further comprising an o-ring forming a watertight seal and an airtight seal between the post socket of the wet niche and the mounting post.

3. The swimming pool accessory mounting system of claim 1 further comprising an electrical line supplying electricity from an electrical source to the wet niche, the electrical line extending through the foundation and accessible by way of the enclosure.

4. The swimming pool accessory mounting system of claim 1 further comprising at least one swimming pool accessory coupled to a second end of the mounting post opposite the first end.

5. The swimming pool accessory mounting system of claim 4, wherein the swimming pool accessory is selected from the group consisting of a barstool, a sofa, a bench, a chair, a hammock, a table, a ladder, an awning, a railing, a lighting structure, a basketball hoop, a volleyball net, and a play structure.

6. The swimming pool accessory mounting system of claim 1, wherein the wet niche further comprises:

a light source housing extending vertically from below the bottom flange, through the bottom flange, and into the enclosure formed by the post socket;

a light source socket formed in the light source housing; and a light source mounted in the light source socket and coupled to an electricity source.

7. The swimming pool accessory mounting system of claim 6, wherein the light source is a light-emitting diode.

8. The swimming pool accessory mounting system of claim 6 further comprising:

a plurality of optical fibers mounted in the mounting post such that when the mounting post is mounted in the post socket, a first end of the optical fibers is located directly above the light source.

9. The swimming pool accessory mounting system of claim 1 further comprising a scent line extending through the foundation and supplying a scent to the enclosure from a scent source.

10. The swimming pool accessory mounting system of claim 1 further comprising a fog line extending through the foundation and supplying a fog to the enclosure from a fog source.

11. A method of removably mounting a swimming pool accessory comprising:

inserting a first end of a mounting post into a post socket of a wet niche located in a floor portion of a swimming pool such that the mounting post extends from the wet niche into the swimming pool, to form a watertight seal and an airtight seal between the post socket of the wet niche and the mounting post, the wet niche comprising:

the post socket having a first end and a second end opposite the first end and forming an enclosure;

a top flange mounted to the first end of the post socket;

a bottom flange mounted to the second end of the post socket;

a face plate mounted to the top flange;

a gasket forming a watertight seal between the top flange and the face plate; and an o-ring forming the watertight seal and the airtight seal between the post socket of the wet niche and the mounting post;

wherein the swimming pool accessory is coupled to a second end of the mounting post opposite the first end; and supplying air from an air source through a foundation and the wet niche to the mounting post to form bubbles and the mounting post has at least one through-hole in a side of the mounting post located underwater when the first end of the mounting post is received by the post socket, such that the air bubbles out of the hole.

12. The method of claim 11, wherein the swimming pool accessory is selected from the group consisting of a barstool, a sofa, a bench, a chair, a hammock, a table, a ladder, an awning, a railing, a lighting structure, a basketball hoop, a volleyball net, and a play structure.

13. The method of claim 11 further comprising supplying electricity from an electrical source through the foundation, the wet niche, and the mounting post to the accessory.

14. The method of claim 11, wherein the step of inserting a first end of a mounting post into a post socket comprises the sub-step of aligning a first end of a plurality of optical fibers mounted in the mounting post with a light source in the wet niche.

15. The method of claim 11 further comprising supplying a scent from a scent source through the foundation and the wet niche to the mounting post.

16. The method of claim 11 further comprising supplying fog from a fog source through the foundation and the wet niche to the mounting post.

* * * * *